US012326105B2

(12) United States Patent
Obata

(10) Patent No.: US 12,326,105 B2
(45) Date of Patent: Jun. 10, 2025

(54) LEAKAGE DETECTION DEVICE FOR PCV PASSAGE, AND VEHICLE

(71) Applicant: SUBARU CORPORATION, Tokyo (JP)

(72) Inventor: Katsumi Obata, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 64 days.

(21) Appl. No.: 18/200,634

(22) Filed: May 23, 2023

(65) Prior Publication Data

US 2023/0392526 A1 Dec. 7, 2023

(30) Foreign Application Priority Data

Jun. 3, 2022 (JP) ..... 2022-090913

(51) Int. Cl.
*F01M 11/10* (2006.01)

(52) U.S. Cl.
CPC ..... *F01M 11/10* (2013.01); *F01M 2011/1446* (2013.01)

(58) Field of Classification Search
CPC ..... F01M 2011/1446; F01M 11/10
See application file for complete search history.

(56) References Cited

U.S. PATENT DOCUMENTS

| | | | | |
|---|---|---|---|---|
| 10,551,272 | B2 * | 2/2020 | Shiwa | G01M 3/007 |
| 10,760,516 | B2 * | 9/2020 | Takahashi | F02D 41/22 |
| 2011/0197864 | A1 * | 8/2011 | Karcher | F02M 25/06 123/574 |
| 2016/0348614 | A1 * | 12/2016 | Dudar | B60T 13/46 |
| 2017/0268448 | A1 | 9/2017 | Takahashi et al. | |

FOREIGN PATENT DOCUMENTS

| | | |
|---|---|---|
| JP | 2013-117176 A | 6/2013 |
| JP | 2017-166449 A | 9/2017 |

* cited by examiner

*Primary Examiner* — Kevin A Lathers
(74) *Attorney, Agent, or Firm* — TROUTMAN PEPPER LOCKE LLP

(57) ABSTRACT

A leakage detection device is configured to perform leakage detection in a positive crankcase ventilation passage including at least a fresh air line configured to allow a communication between a crank chamber and an intake passage that constitute an engine. The leakage detection device includes a pressure sensor, a leakage determination unit, and a shut-off mechanism. The pressure sensor is configured to communicate with the positive crankcase ventilation passage and to detect a pressure in the positive crankcase ventilation passage. The leakage determination unit is configured to determine whether leakage occurs in the positive crankcase ventilation passage, based on the pressure in the positive crankcase ventilation passage when the positive crankcase ventilation passage is closed. The shut-off mechanism is configured to shut the pressure sensor off from the positive crankcase ventilation passage except when whether leakage occurs is determined.

6 Claims, 5 Drawing Sheets

LEAKAGE DETECTION DEVICE FOR PCV PASSAGE, AND VEHICLE

CROSS-REFERENCE TO RELATED APPLICATION

The present application claims priority from Japanese Patent Application No. 2022-090913 filed on Jun. 3, 2022, the entire contents of which are hereby incorporated by reference.

BACKGROUND

The disclosure relates to a leakage detection device for detecting leakage that occurs in a passage of a PCV circuit provided for, for example, a gasoline engine.

Existing engines for automobiles include a positive crankcase ventilation (PCV) circuit for guiding, to an intake passage, the blow-by gas that leaks from a combustion chamber into a crankcase through a gap between a cylinder and a piston.

During such guiding of the blow-by gas, when leakage occurs, due to some cause, in a passage of the PCV circuit (also referred to as a "PCV passage") through which the blow-by gas flows, the blow-by gas may be released into the atmosphere outside the engine. Thus, for example, Japanese Unexamined Patent Application Publication (JP-A) No. 2013-117176 proposes a technology for, after measuring a pressure in a crankcase, detecting such leakage in the PCV passage based on the pressure.

Similarly, JP-A No. 2017-166449 proposes pressure sensors in a leakage detection device, one of which is attached to a crankcase and measures the pressure in a crank chamber, and one of which is attached to an intake manifold and measures the pressure in the intake manifold.

SUMMARY

An aspect of the disclosure provides a leakage detection device configured to perform leakage detection in a positive crankcase ventilation passage including at least a fresh air line configured to allow a communication between a crank chamber and an intake passage that constitute an engine. The leakage detection device includes a pressure sensor, a leakage determination unit, and a shut-off mechanism. The pressure sensor is configured to communicate with the positive crankcase ventilation passage and to detect a pressure in the positive crankcase ventilation passage. The leakage determination unit is configured to determine whether leakage occurs in the positive crankcase ventilation passage, based on the pressure in the positive crankcase ventilation passage when the positive crankcase ventilation passage is closed. The shut-off mechanism is configured to shut the pressure sensor off from the positive crankcase ventilation passage except when whether leakage occurs is determined.

An aspect of the disclosure provides a vehicle including the leakage detection device for the positive crankcase ventilation passage.

An aspect of the disclosure provides a leakage detection device configured to perform leakage detection in a positive crankcase ventilation passage including at least a fresh air line configured to allow a communication between a crank chamber and an intake passage that constitute an engine of a vehicle. The leakage detection device includes a pressure sensor, circuitry, and a shut-off mechanism. The pressure sensor is configured to communicate with the positive crankcase ventilation passage and to detect a pressure in the positive crankcase ventilation passage. The circuitry is configured to determine whether leakage occurs in the positive crankcase ventilation passage, based on the pressure in the positive crankcase ventilation passage when the positive crankcase ventilation passage is closed. The shut-off mechanism includes a value and is configured to shut the pressure sensor off from the positive crankcase ventilation passage except when whether leakage occurs is determined.

An aspect of the disclosure provides a vehicle including the leakage detection device for the positive crankcase ventilation passage.

BRIEF DESCRIPTION OF THE DRAWINGS

The accompanying drawings are included to provide a further understanding of the disclosure and are incorporated in and constitute a part of this specification. The drawings illustrate the embodiment and, together with the specification, serve to describe the principles of the disclosure.

DETAILED DESCRIPTION

Existing technologies including those in JP-A No. 2013-117176 and JP-A No. 2017-166449 cited above may hardly satisfy potential needs regarding the leakage detection described above and thus have a room for improvement.

For example, each of the technologies in JP-A No. 2013-117176 and JP-A No. 2017-166449 enables, with a pressure sensor, leakage detection with high accuracy in conducting a leakage diagnosis according to change in pressure. However, in the first place, blow-by gas flows through the PCV circuit, that is, the pressure sensor will be placed in a corrosive environment. Such corrosion of the pressure sensor may lead to abnormality in measurement. Thus, it is desirable to close the pressure sensor off from the corrosive environment as much as possible in the leakage detection.

It is desirable to provide a leakage detection device for a PCV passage and a vehicle whose pressure sensor for detecting leakage of blow-by gas can be closed off from a corrosive environment as much as possible.

In the following, an embodiment of the disclosure is described in detail with reference to the accompanying drawings. Note that the following description is directed to an illustrative example of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following example embodiment which are not recited in a most-generic independent claim of the disclosure are optional and may be provided on an as-needed basis. The drawings are schematic and are not intended to be drawn to scale. Throughout the present specification and the drawings, elements having substantially the same function and configuration are denoted with the same numerals to avoid any redundant description. The embodiment may be put in use by appropriately complementing constituents, except those to be detailed below, from a known engine structure such as one in JP-A No. 2017-166449.

Engine 10

Figure 1:
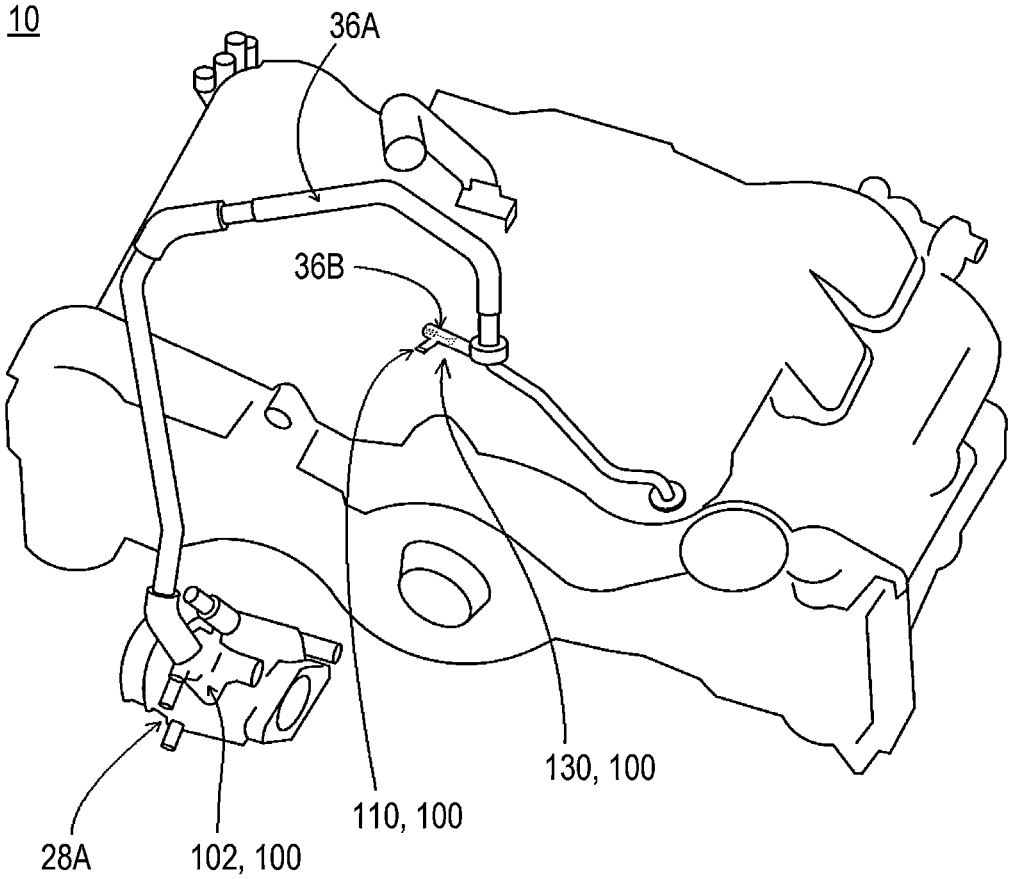
FIG. 1 is a schematic view of a fresh air line of an engine mounted on a vehicle according to an embodiment.

The configuration of an engine 10 to be mounted on a vehicle of the embodiment of the disclosure will be described with reference to FIG. 1, FIG. 2, and other figures. Examples of the vehicle of the embodiment include two-wheeled and four-wheeled automobiles each including a known transmission and include a known hybrid vehicle further including an electric motor.

The engine 10 of the embodiment may be a horizontally opposed four-cylinder engine in which two cylinder blocks 12 having cylinder bores 13 that face one another with a crankshaft 11 therebetween. Each of the cylinder blocks 12 and a crankcase 14 are formed as one body. A cylinder head 15 is disposed to be fixed to the side of the cylinder block 12 opposite from the crankcase 14.

The crankshaft 11 is provided in a crank chamber CR defined by the crankcase 14 and is rotatably supported by a known bearing. A piston 18 coupled to the crankshaft 11 with a connecting rod 17 therebetween is slidably provided in the cylinder bore 13. Thus, a space surrounded by the cylinder bore 13, the cylinder head 15, and a crown surface of the piston 18 serves as a combustion chamber 19 of the engine 10 in the embodiment.

The cylinder head 15 has an intake port 20 and an exhaust port 21 that communicate with the combustion chamber 19. The distal end part of an intake valve 22 is positioned between the intake port 20 and the combustion chamber 19. The distal end part of an exhaust valve 23 is positioned between the exhaust port 21 and the combustion chamber 19. A known intake-valve cam 25 and a known exhaust-valve cam 26 are provided in a cam chamber surrounded by the cylinder head and a head cover 24.

The intake-valve cam 25 is in contact with the other end part of the intake valve 22 and can move the intake valve 22 forward and backward in the axial direction by being rotated by the action of an intake camshaft. On the other hand, the exhaust-valve cam 26 is in contact with the other end part of the exhaust valve 23 and can move the exhaust valve 23 forward and backward in the axial direction by being rotated by the action of an exhaust camshaft.

Figure 2:
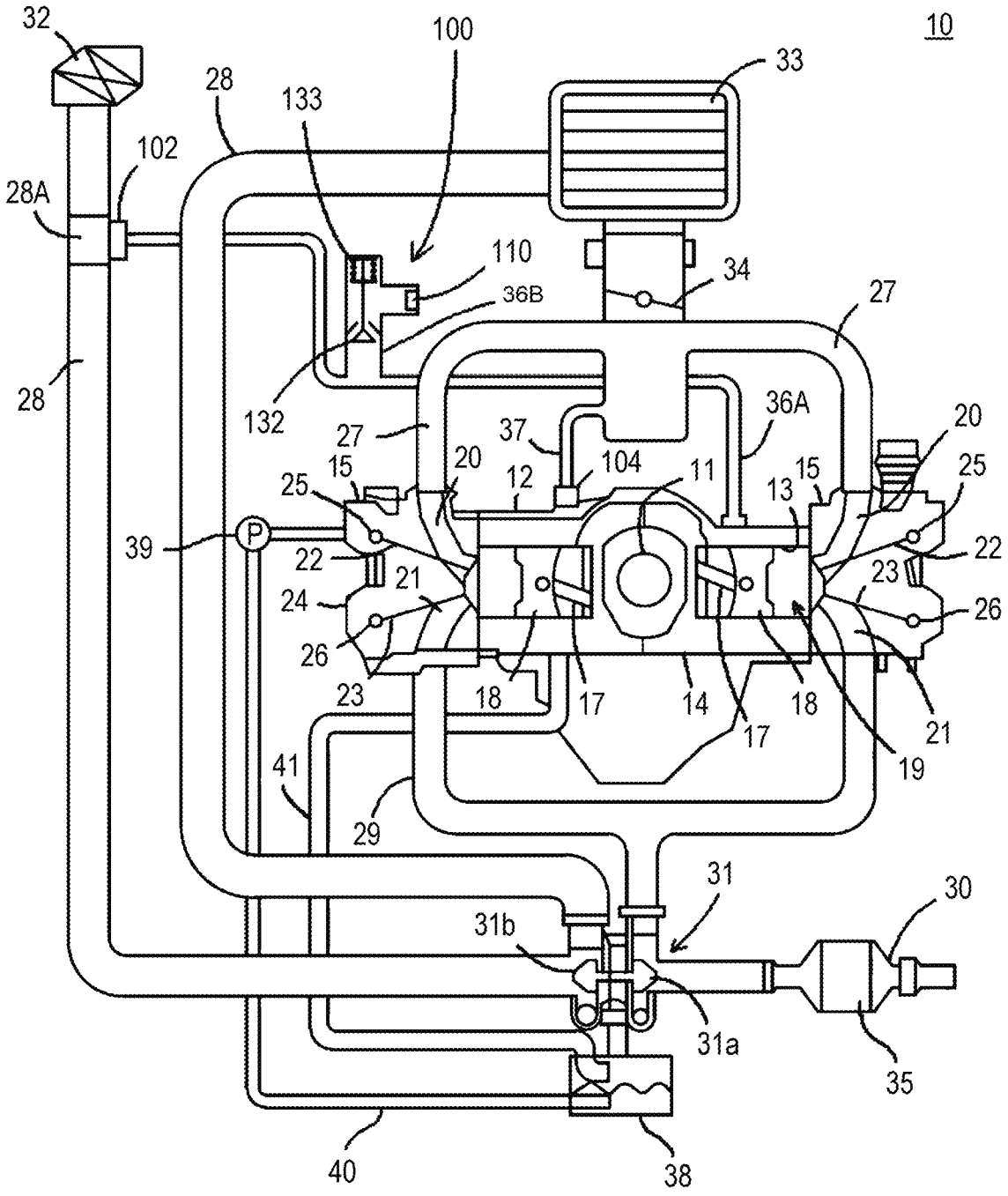
FIG. 2 is a schematic view of the engine including a leakage detection device according to the embodiment.

As FIG. 2 illustrates, an intake passage 28 including a known intake manifold 27 communicates with the upstream part of the intake port 20 of the embodiment. The intake passage 28 is provided with, for example, a known air cleaner 32, a known compressor 31*b* of a known supercharger 31, a known intercooler 33, and a known throttle valve 34. An exhaust passage 30 including a known exhaust manifold 29 communicates with the downstream part of the exhaust port 21 of the embodiment. The engine 10 of the embodiment includes the known supercharger 31 as described above. Thus, the exhaust gas discharged from the combustion chamber 19 is collected in the exhaust manifold 29 via the exhaust port 21 and is then guided to the supercharger 31.

That is, the exhaust gas generated by combustion is guided to a turbine 31*a* of the supercharger 31 via the exhaust port 21 and the exhaust manifold 29. After rotating the turbine 31*a* in the supercharger 31, the exhaust gas is purified by a known catalyst 35 provided in the exhaust passage 30 and is then discharged outside the vehicle.

The engine 10 of the embodiment is further provided with a fresh air line 36A for guiding air (fresh air) to the crankcase 14. The fresh air line 36A communicates between, for example, a part of the intake passage 28 between the air cleaner 32 and the compressor 31*b* and the crank chamber CR formed in the crankcase 14. There is no limitation in properties of the material for the fresh air line 36A, and a known material, for example, used for the fresh air line disclosed in JP-A No. 2017-166449 may be used.

The fresh air line 36A and the intake passage 28 are coupled to one another with a first passage open-close valve 102 therebetween. Thus, with a control device (leakage determination unit 120), which will be described later, the first passage open-close valve 102 can shut the fresh air line 36A off from the intake passage 28 and can cause the fresh air line 36A to communicate with the intake passage 28. Examples of the first passage open-close valve 102 include various known valve mechanisms capable of blocking the flow of gas.

The engine 10 of the embodiment is further provided with a scavenging line 37 for scavenging the blow-by gas in the crank chamber CR formed in the crankcase 14. The scavenging line 37 communicates between the crank chamber CR and the intake manifold 27. There is no limitation in properties of the material for the scavenging line 37, and a known material, for example, used for the scavenging line disclosed in JP-A No. 2017-166449 may be used.

As FIG. 2 illustrates, a second passage open-close valve 104 is provided at a part where the scavenging line 37 and the crank chamber CR are coupled to one another. The second passage open-close valve 104 causes the scavenging line 37 to communicate with the crank chamber CR and shuts the scavenging line 37 off from the crank chamber CR. Examples of the second passage open-close valve 104 include various known valve mechanisms capable of blocking the flow of gas as with the first passage open-close valve 102.

A known oil catch tank 38 is provided below the supercharger 31. The oil collected in the oil catch tank 38 is sucked by a known scavenging pump 39 and is returned to an oil pan of the engine 10 via a suction line 40. The oil catch tank 38 is coupled to the crank chamber CR formed in the crankcase 14, by a balance line 41.

The pressure inside the oil catch tank 38 is maintained equal to the pressure inside the crank chamber by the balance line 41 communicating between the crank chamber CR and the oil catch tank 38. The balance line 41, with the fresh air line 36A and the scavenging line 37, constitutes a PCV system in the engine 10.

Thus, in the embodiment, a PCV passage is defined as a passage constituted by the fresh air line 36A, the scavenging line 37, and the balance line 41.

Leakage Detection Device 100

The configuration of a leakage detection device 100 will now be described, further with reference to FIG. 3. The leakage detection device 100 performs leakage detection in the PCV passage including at least the fresh air line 36A that communicates between the crank chamber CR and the intake passage 28 that constitute the engine 10.

In one example, the leakage detection device 100 of the embodiment includes the first passage open-close valve 102, a pressure sensor 110, the leakage determination unit 120, and a shut-off mechanism 130.

The pressure sensor 110 communicates with the PCV passage and detects the pressure in the PCV passage.

Examples of the pressure sensor 110 include any known pressure sensor without limitation.

Figure 3:
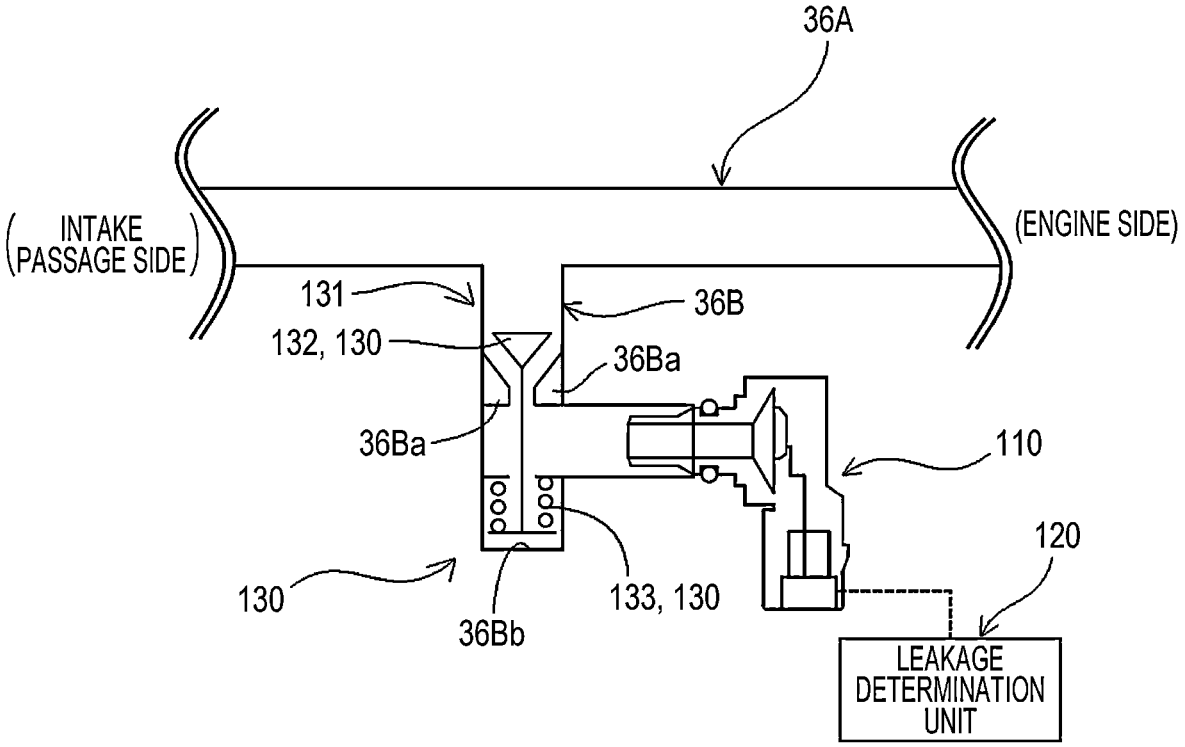
FIG. 3 is a schematic view of the detailed structure of the leakage detection device according to the embodiment.

As FIG. 3 illustrates, the pressure sensor 110 of the embodiment is provided in a branch line 36B branching off from the fresh air line 36A. Because the branch line 36B of the embodiment branches off from the fresh air line 36A, the pressure in the fresh air line 36A can be measured via the branch line 36B.

As FIG. 3 illustrates, the branch line 36B of the embodiment has an opening part 36Ba at which the passage diameter of the branch line 36B is reduced. The opening part 36Ba is formed at the inner wall of the branch line 36B so as to be closed, from the fresh air line 36A side, by a plug member 132, which will be described later.

The leakage determination unit 120 determines whether leakage occurs in the PCV passage, based on the pressure in the PCV passage when the PCV passage is closed. The leakage determination unit 120 may be constituted by a control device including one or more electronic control units (ECUs).

In another example, the control device may be constituted by, for example, a known computer including one or more processors and one or more memories communicably coupled to the one or more processors. Examples of such a processor include a central processing unit (CPU), and examples of such a memory include a random access memory (RAM) and a read only memory (ROM). All or a part of the control device may be constituted by updatable software such as firmware or may be constituted by, for example, a program module that is executed in response to a command from the processor.

The shut-off mechanism 130 shuts the pressure sensor 110 off from the PCV passage except when the leakage determination unit 120 determines whether leakage occurs.

In one example, as understood from FIG. 3, the shut-off mechanism 130 of the embodiment includes a one-way valve 131 provided, in the branch line 36B, upstream of the pressure sensor 110.

The one-way valve 131, as described later, is opened when the fresh air line 36A is under negative pressure, and the one-way valve 131 is closed when the fresh air line 36A is under positive pressure. In one example, the one-way valve 131 of the embodiment has the opening part 36Ba serving as a valve seat provided at the inner wall of the branch line 36*b*, the plug member 132 serving as a valve body that closes and opens the opening part 36Ba, and an elasticity imparting member 133 that is coupled to the plug member 132 and pushes the plug member 132 against the opening part 36Ba.

As FIG. 3 illustrates, the elasticity imparting member 133 is provided at a bottom surface 36Bb of the branch line 36B and applies a pressure so that the plug member 132 attached to a tip side of the elasticity imparting member 133 is brought closer to the opening part 36Ba. Examples of the elasticity imparting member 133 include a known elastic spring. Thus, in the embodiment, the plug member 132 closes the opening part 36Ba due to the action of the elasticity imparting member 133 unless the fresh air line 36A, which will be described later, is under negative pressure.

In the embodiment, when, for example, the fresh air line 36A is shut off from the intake passage 28 by the first passage open-close valve 102 and is placed under negative pressure, the action of the negative pressure detaches the plug member 132 from the opening part 36Ba, and the pressure sensor 110 thereby communicates with the fresh air line 36A.

In other words, in the leakage detection device 100 of the embodiment, the pressure sensor 110 can communicate with the fresh air line 36A only when the fresh air line 36A is placed under negative pressure by using the first passage open-close valve 102 at a time when the leakage detection of blow-by gas is performed, and the pressure sensor 110 can be isolated from the fresh air line 36A except the time when the leakage detection is performed.

Thus, the pressure sensor 110 that performs the leakage detection of blow-by gas can be closed off from the corrosive environment as much as possible, and, for example, reduction suppression of leakage detection accuracy and maintenance frequency reduction can be achieved.

In the embodiment, as FIG. 3 illustrates, the branch line 36B is provided for the fresh air line 36A, and the pressure sensor 110 is disposed in the branch line 36B via the shut-off mechanism 130. However, the leakage detection device 100 of the embodiment may be used at any part continuously communicating with the inside of the crank.

Flows of Blow-by Gas During Supercharging Operation and Non-supercharging (Natural Aspiration) Operation The timing of the leakage detection in the embodiment will now be described by referring to the flow states of blow-by gas at times of a supercharging operation and a non-supercharging (natural aspiration) operation. Such a time of the non-supercharging operation in the embodiment includes a case of an operation, of an engine not including the supercharger 31, performed by natural aspiration.

That is, the fresh air line 36A and the scavenging line 37 are used mainly for discharging the blow-by gas in the crank chamber CR. The flowing direction or route of air to flow the fresh air line 36A and the scavenging line 37 differs between the time of the non-supercharging (natural aspiration) operation, in which the engine 10 is not supercharged with intake air, and the time of the supercharging operation, in which the engine 10 is supercharged with the intake air by the supercharger 31. Hereinafter, the description continues while the fresh air line 36A of the PCV passage is taken as an example.

Figure 4:
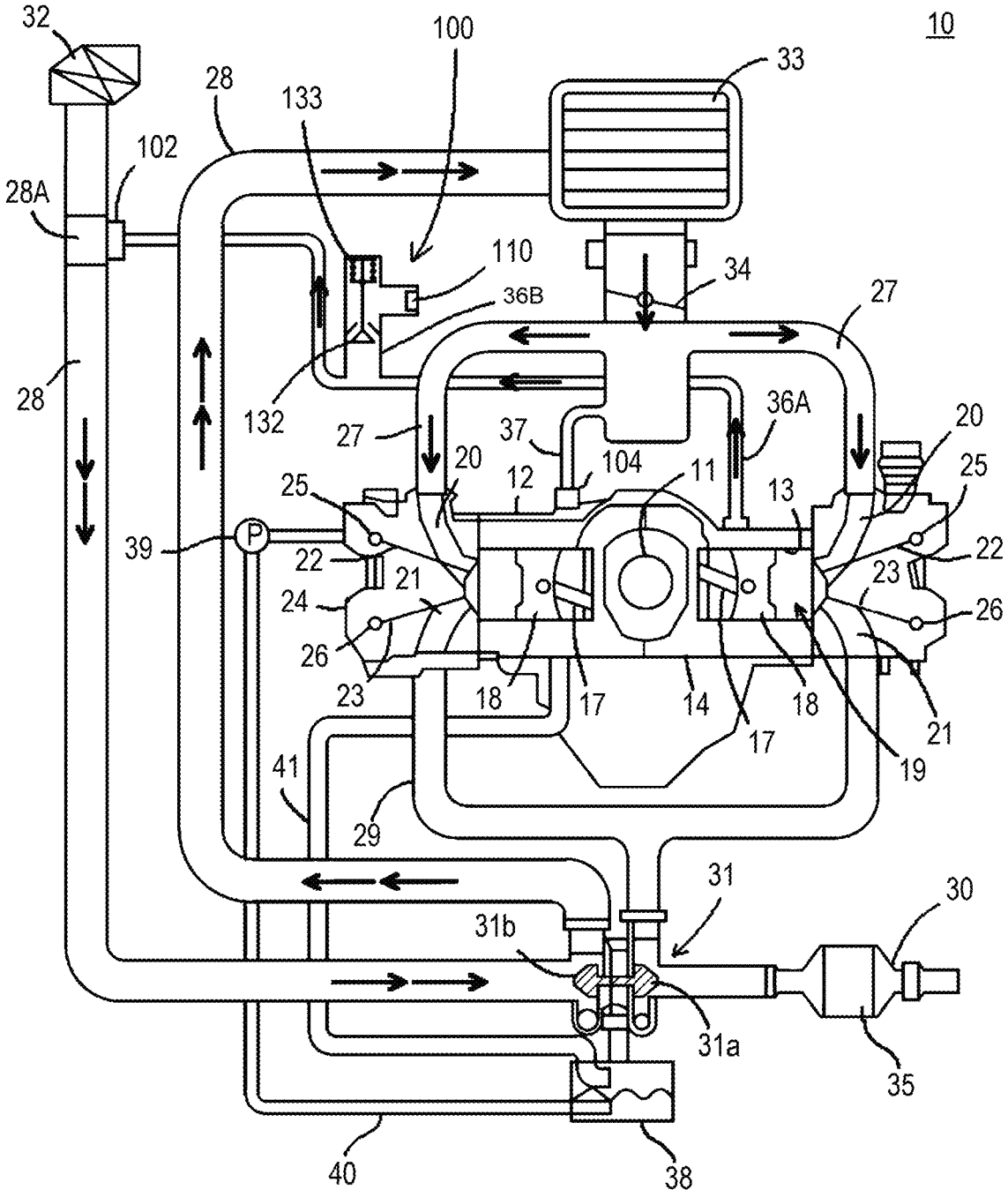
FIG. 4 illustrates a flow of blow-by gas during a supercharging operation.

That is, during the supercharging operation, as FIG. 4 illustrates, the supercharging action of the supercharger 31 increases the internal pressure of the intake manifold 27. Accordingly, the internal pressure of the crank chamber CR is also increased and becomes higher than the internal pressure of the fresh air line 36A. Thus, fresh air cannot flow from the intake passage 28 into the fresh air line 36A, the blow-by gas flows backward from the crankcase 14, and the blow-by gas in the crankcase 14 cannot be collected.

That is, in this supercharging state described just above, the blow-by gas in the crankcase 14 may flow into the fresh air line 36A when the first passage open-close valve 102 is opened, and the internal pressure of the fresh air line 36A may be increased when the first passage open-close valve 102 is closed. Thus, if the leakage detection is attempted in the supercharging state, the pressure sensor 110 will be increasingly contaminated by blow-by gas with the first passage open-close valve 102 opened, and the plug member 132 will remain pushed against the opening part 36Ba to close the opening part 36Ba with the first passage open-close valve 102 closed.

Figure 5:
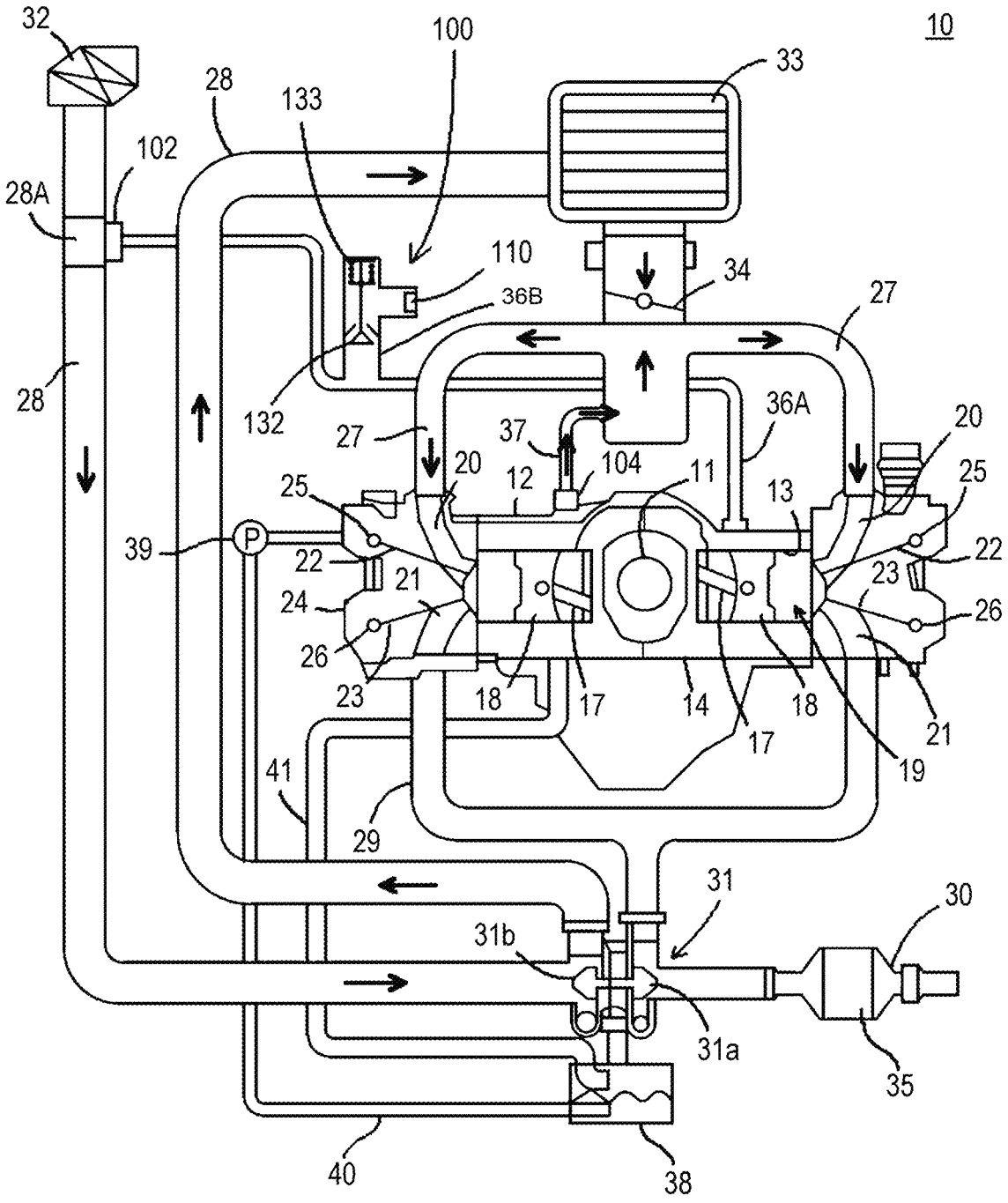
FIG. 5 illustrates a flow of blow-by gas during a non-supercharging (natural aspiration) operation.

On the other hand, during the non-supercharging (natural aspiration) operation, as FIG. 5 illustrates, the internal pressure of the intake manifold 27 is not increased as much as the internal pressure of the intake manifold 27 during the supercharging operation, and the action of piston motion in the engine 10 causes the internal pressure of the crankcase 14 to become negative relative to the fresh air line 36A.

That is, in this non-supercharging (natural aspiration) state of the engine 10, with the first passage open-close valve 102 opened, scavenging can be performed via the scavenging line 37. Accordingly, the blow-by gas in the crankcase 14 flows out into the scavenging line 37, and fresh air (air to be newly introduced) is introduced from the intake passage 28 into the crankcase 14 via the fresh air line 36A.

Thus, air including blow-by gas does not flow backward from the crankcase 14 into the fresh air line 36A during the non-supercharging (natural aspiration) operation, and the leakage determination unit 120 can perform the leakage detection of blow-by gas during the non-supercharging (natural aspiration) operation.

When the leakage detection is performed, the leakage determination unit 120, by controlling, initially closes the first passage open-close valve 102.

When the first passage open-close valve 102 is closed, the fresh air line 36A is placed under negative pressure, the plug member 132 becomes detached from the opening part 36Ba against the elastic force of the elasticity imparting member 133. Thus, the branch line 36B communicates between the fresh air line 36A and the pressure sensor 110, and a pressure value in the fresh air line 36A (PCV passage) can be measured.

At this time, when the pressure value measured by the pressure sensor 110 is more than a predetermined value, the leakage determination unit 120 can determine that leakage may occur in the PCV passage due to some cause. On the other hand, when the pressure value measured by the pressure sensor 110 drops to the predetermined value, the leakage determination unit 120 can determine that there is no leakage in the PCV passage. The predetermined value may be changed depending on the number of cylinders of the engine 10 and the specifications of the engine 10 but can be set in advance, for example, through an experiment or a simulation.

As described above, according to the leakage detection device 100 of the embodiment and the vehicle including the leakage detection device 100, the pressure sensor 110 is placed in a blow-by gas environment only when the leakage detection of blow-by gas is performed, and the pressure sensor can thereby be guarded against corrosion as much as possible.

In the above description, the embodiment and modification examples of the disclosure are detailed with reference to the accompanying drawings. However, the disclosure is not limited to the embodiment and modification examples. It is highly probable that a person skilled in the art related to the disclosure will attempt further alterations to the embodiment and modification examples within the range of the technical ideas stated in the claims, and the altered embodiment and modification examples are to be included in the technical scope of the disclosure.

The leakage determination unit 120 illustrated in FIG. 3 can be implemented by circuitry including at least one semiconductor integrated circuit such as at least one processor (e.g., a central processing unit (CPU)), at least one application specific integrated circuit (ASIC), and/or at least one field programmable gate array (FPGA). At least one processor can be configured, by reading instructions from at least one machine readable tangible medium, to perform all or a part of functions of the leakage determination unit 120. Such a medium may take many forms, including, but not limited to, any type of magnetic medium such as a hard disk, any type of optical medium such as a CD and a DVD, any type of semiconductor memory (i.e., semiconductor circuit) such as a volatile memory and a non-volatile memory. The volatile memory may include a DRAM and a SRAM, and the non-volatile memory may include a ROM and a NVRAM. The ASIC is an integrated circuit (IC) customized to perform, and the FPGA is an integrated circuit designed to be configured after manufacturing in order to perform, all or a part of the functions of the module illustrated in FIG. 3.

The invention claimed is:

1. A leakage detection device configured to perform leakage detection in a positive crankcase ventilation passage including at least a fresh air line configured to allow a communication between a crank chamber and an intake passage that constitute an engine, the leakage detection device comprising:

a pressure sensor provided in a branch line branching off from the fresh air line of the positive crankcase ventilation passage and to detect a pressure in the positive crankcase ventilation passage;

a one-way valve provided upstream of the pressure sensor in the branch line, the one-way valve being configured to be opened when the fresh air line is under negative pressure and to be closed when the fresh air line is under positive pressure;

one or more processors; and one or more memories storing instructions for causing the one or more processors to determine whether leakage occurs in the positive crankcase ventilation passage, based on the pressure in the positive crankcase ventilation passage when the positive crankcase ventilation passage is closed by a passage open-close valve, the passage open-close valve being provided upstream of the pressure sensor and coupling the fresh air line with the intake passage.

2. The leakage detection device according to claim 1, wherein the one-way valve comprises a plug member configured to close and open an opening part provided at an inner wall of the branch line, and an elasticity imparting member coupled to the plug member and configured to push the plug member against the opening part.

3. A vehicle comprising the leakage detection device according to claim 1.

4. A vehicle comprising the leakage detection device according to claim 2.

5. A leakage detection device configured to perform leakage detection in a positive crankcase ventilation passage including at least a fresh air line configured to allow a communication between a crank chamber and an intake passage that constitute an engine of a vehicle, the leakage detection device comprising:

a pressure sensor provided in a branch line branching off from the fresh air line of the positive crankcase ventilation passage and configured to detect a pressure in the positive crankcase ventilation passage;

a one-way valve provided upstream of the pressure sensor in the branch line, the one-way valve being configured to be opened when the fresh air line is under negative pressure and to be closed when the fresh air line is under positive pressure; and circuitry configured to determine whether leakage occurs in the positive crankcase ventilation passage, based on the pressure in the positive crankcase ventilation passage when the positive crankcase ventilation passage is closed by a passage open-close valve, the passage open-close valve being provided upstream of the pressure sensor and coupling the fresh air line with the intake passage.

6. A vehicle comprising
the leakage detection device according to claim 5.

* * * * *